US009795263B1

(12) United States Patent
Perkins

(10) Patent No.: US 9,795,263 B1
(45) Date of Patent: Oct. 24, 2017

(54) COLLECTION AND SIFTING DEVICE FOR VACUUMED DEBRIS

(71) Applicant: Todd Perkins, Pasco, WA (US)

(72) Inventor: Todd Perkins, Pasco, WA (US)

(73) Assignee: Todd Perkins, Pasco, WA (US)

( * ) Notice: Subject to any disclaimer, the term of this patent is extended or adjusted under 35 U.S.C. 154(b) by 0 days.

(21) Appl. No.: 15/259,261

(22) Filed: Sep. 8, 2016

(51) Int. Cl.

| | |
|---|---|
| ***B07B 1/49*** | (2006.01) |
| ***A47L 9/10*** | (2006.01) |
| ***B07B 1/02*** | (2006.01) |
| ***B07B 1/06*** | (2006.01) |

(52) U.S. Cl.
CPC ..... *A47L 9/102* (2013.01); *B07B 1/02* (2013.01); *B07B 1/06* (2013.01)

(58) Field of Classification Search
CPC .... B07B 1/02; B07B 1/06; B07B 1/46; B07B 1/4636; B01D 45/02; B01D 45/18; B01D 46/0004; B01D 2221/16; B03B 4/06
See application file for complete search history.

(56) References Cited

U.S. PATENT DOCUMENTS

| | | | | |
|---|---|---|---|---|
| 2,398,955 | A | 4/1946 | O'Toole | |
| 3,170,875 | A | 2/1965 | Swett | |
| 3,535,730 | A | 10/1970 | McClure | |
| 3,759,577 | A | 9/1973 | Manzer | |
| 4,118,208 | A | 10/1978 | Klinedinst | |
| 4,932,082 | A * | 6/1990 | Ridgeway | E03C 1/23 4/287 |
| 5,178,655 | A | 1/1993 | Sassier | |
| 5,368,170 | A | 11/1994 | Leis | |
| 5,440,780 | A | 8/1995 | Rakocy et al. | |
| 5,507,248 | A | 4/1996 | Gabbert | |
| 6,840,972 | B1 * | 1/2005 | Kim | 55/337 |
| 8,764,990 | B1 * | 7/2014 | Julian | B01D 29/13 210/248 |
| 2003/0101533 | A1 | 6/2003 | Noreen et al. | |
| 2007/0294858 | A1 | 12/2007 | Murphy | |
| 2007/0295227 | A1 | 12/2007 | Raineri | |

FOREIGN PATENT DOCUMENTS

| | | | | |
|---|---|---|---|---|
| WO | WO-95/05981 | A1 * | 3/1995 | B65D 69/00 |

* cited by examiner

*Primary Examiner* — Mark Beauchaine
(74) *Attorney, Agent, or Firm* — Randall Danskin P.S.

(57) ABSTRACT

A collection and sifting device provides a flexibly resilient truncated funnel shaped body having a top circumferential edge extending around an open top portion, and a spaced apart bottom circumferential edge extending about a diametrically smaller closed bottom portion with a sidewall extending between the top circumferential edge and the bottom circumferential edge. A plurality of spacedly arrayed through holes are defined in the bottom portion and in the sidewall proximate the bottom portion. Each spacedly arrayed through hole has a diameter smaller than a diameter of a U.S. dime. A bottom cap is releasably securable to the body to optionally obstruct the plurality of through holes.

3 Claims, 7 Drawing Sheets

COLLECTION AND SIFTING DEVICE FOR VACUUMED DEBRIS

TECHNICAL FIELD

The present invention relates to sifting devices, and more particularly to a collection body carried within a vacuum that provides for sifting of the vacuumed debris so that desirable items may be separated from waste.

BACKGROUND OF THE INVENTION

Vacuum cleaning devices operate using the fundamental principles of fluid dynamics.

Most vacuums comprise a rigid outer housing that contains a motor, an air impeller, and a dust and dirt filter as well as a collection/reservoir which is most often in the form of a disposable filter bag. The housing defines an air entry port to which a hose assembly is mounted. In operation, dust, waste, dirt and debris pass through the hose and into the housing where the dust, waste, dirt and debris are collected while filtered air is forcefully pushed out of the housing into the ambient environment. The motor which spins the air impeller, transfers an air load from the air entry port, (which is a terminal end of the hose), to an air outlet port which is the exhaust. The transfer of the air load from the inlet to the exhaust creates a region of low pressure within the housing and the pressure differential creates suction whereby particles, debris, dirt and dust are propelled toward the lower pressure region through a medial channel defined by the hose. The greater the pressure difference between the region of low pressure and the region of ambient pressure, the greater the suction.

Most car wash facilities, and other facilities for cleaning motor vehicles provide customer access to coin operated vacuum devices that are used by customers to clean the interiors of vehicles. The car wash vacuums typically include an elongated hose that communicates with the vacuum housing and the hose terminates in a suction head which a user manipulates over and across seats, carpets, dashboards and the like inside the vehicle so that dust, debris, dirt and the like is removed from surfaces, carpets, seats, floors and the like.

As most individuals of driving age know, over periods of time, loose change, and perhaps dollar bills are lost, dropped, or otherwise inadvertently disbursed through the interior of the vehicle, between the seats, between the cushions, under the seats, under the floor mats and the like. Thereafter, when a vehicle is being cleaned with a vacuum, the suction head is inserted between the seats, between the cushions, under the seats, under the floor mats and the like, and in the course of such vacuuming, loose change, and perhaps dollar bills are picked up and sucked into the suction head and thereafter moved through the hose into the vacuum housing and to the reservoir. Although in some cases the vacuuming up of loose change may be intentional, most of the time the vacuuming of such valuables is unintentional and probably unknown because of the location of the change and the manipulation of the suction head.

Heretofore, when such change and valuable items were vacuumed up in carwash vacuum apparatus, the valuable items and change were deposited into the dirt and debris reservoir within the vacuum housing. On a periodic basis, the operator or maintenance person of the vacuum would empty the collected contents of the reservoir into a trash receptacle and in the course of doing so would also "throw out" or otherwise dispose of the coins and valuables that were within the debris.

If an owner/operator of a carwash facility having powered vacuums wanted to retain the coins and other valuables, the process required the owner or operator to manually sift through the dirt, debris and waste collected within the container/receptacle. Such a process is manual, dirty, smelly, unsanitary and time consuming.

Therefore, there remains a need for an apparatus that allows a user to easily, quickly and sanitarily separate vacuumed up debris and waste from a vacuum cleaner while retaining items of value.

As described, some or all of the drawbacks and problems explained above, and other drawbacks and problems not yet recognized, may be helped or solved by the instant invention shown and described herein. The invention may also be used to address other problems not set out herein or which may become apparent at a later time. The future may also bring to light unknown benefits that may, in the future, be appreciated by the novel invention shown and described herein.

The instant invention does not reside in any one of the identified features individually, but rather in the synergistic combination of all of its structures, which give rise to the functions necessarily flowing therefrom as hereinafter specified and claimed.

SUMMARY OF THE INVENTION

A collection and sifting device provides a flexibly resilient truncated funnel shaped body having a top circumferential edge extending around an open top portion, and a spaced apart bottom circumferential edge extending about a diametrically smaller closed bottom portion with a sidewall extending between the top circumferential edge and the bottom circumferential edge. A plurality of spacedly arrayed holes are defined in the bottom portion and in the sidewall proximate the bottom portion. Each spacedly arrayed hole has a diameter smaller than a diameter of a U.S. dime. A bottom cap releasably securable to the body optionally obstructs the plurality of holes to retain materials collected within the body.

A first aspect of the present invention is a sifting device comprising a resiliently deformable body having an open top portion defining an upper diameter and a closed bottom portion defining a bottom diameter with a side wall extending between the open top portion and the closed bottom portion and wherein, the body defines an interior volume between the open top portion and the closed bottom portion and an interior surface of the side wall and wherein the body further defines a plurality of spacedly arrayed through holes in the closed bottom portion and each of the spacedly arrayed holes has a diameter and a bottom cap releasably securable to the body to obstruct the plurality of spacedly arrayed holes defined in the closed bottom when the bottom cap is oriented in a closed position relative to the body.

A second aspect of the present invention is wherein the sifting device is operatively carried within a housing of a vacuum.

A third aspect of the present invention is wherein the diameter of each of the plurality of holes defined in the closed bottom portion is less than approximately 18 mm.

A fourth aspect of the present invention is wherein the diameter of each of the plurality of holes defined in the closed bottom portion is less than a diameter of a US dime.

A fifth aspect of the present invention is wherein the body has a peripheral configuration of a truncated funnel.

A sixth aspect of the present invention is wherein the diameter of the open top portion is larger than the diameter of the closed bottom portion.

A seventh aspect of the present invention is wherein the body is formed of rubber.

An eighth aspect of the present invention is wherein the body is formed of plastic.

A ninth aspect of the present invention is wherein the bottom cap is attached to the body by means of a hinge.

A tenth aspect of the present invention further comprises a plurality of through holes defined in the side wall of the body, proximate the closed bottom.

An eleventh aspect of the present invention is wherein the bottom cap carries a circumferentially extending sidewall that extends angularly from an upper surface of the bottom cap to communicate with the exterior surface of the body sidewall and to obstruct the through holes defined in the sidewall of the body.

A twelfth aspect of the present invention further comprises a handle carried by the body proximate the open top portion.

A thirteenth aspect of the present invention further comprises a connection communicating between the exterior surface of the sidewall and the bottom cap to secure the bottom cap in a closed position relative to the body.

A fourteenth aspect of the present invention is a collecting and sifting device for catching and separating vacuumed up debris, the device comprising a resiliently deformable rubber body having an open top portion defining an upper diameter and a closed bottom portion defining a bottom diameter that is smaller than the upper diameter with a side wall extending between the top portion and the closed bottom portion, the body defining an interior volume between the open top portion and the closed bottom portion and an interior surface of the side wall. The body further defining a plurality of spacedly arrayed through holes defined in the closed bottom portion and in the side wall proximate the closed bottom portion, each of the spacedly arrayed through holes having a diameter that is less than a diameter of a US dime and each of the spacedly arrayed through holes extending from the internal surface of the body within the interior volume to an exterior surface of the body opposite the interior volume. Two generally diametrically opposed handles carried by the body proximate to the open top portion facilitate handling by an operator and agitation of the debris collected within the interior volume. A bottom cap having an upper surface and a circumferentially extending sidewall extending angularly from the upper surface is releasably securable to the body to optionally obstruct the plurality of spacedly arrayed through holes defined in the closed bottom and in the body side wall when the bottom cap is oriented in a closed position and a means to retain the bottom cap in a closed orientation relative to the body.

DETAILED DESCRIPTION OF THE PREFERRED EMBODIMENTS

This disclosure of the invention is submitted in furtherance of the Constitutional purposes of the U.S. Patent Laws "to promote the progress of science and useful arts" (Article 1, Section 8).

A collection and sifting device for vacuumed debris generally provides a resiliently deformable body 20 and bottom cap 40 for collection of vacuumed debris within a powered vacuum 60.

Figure 1:
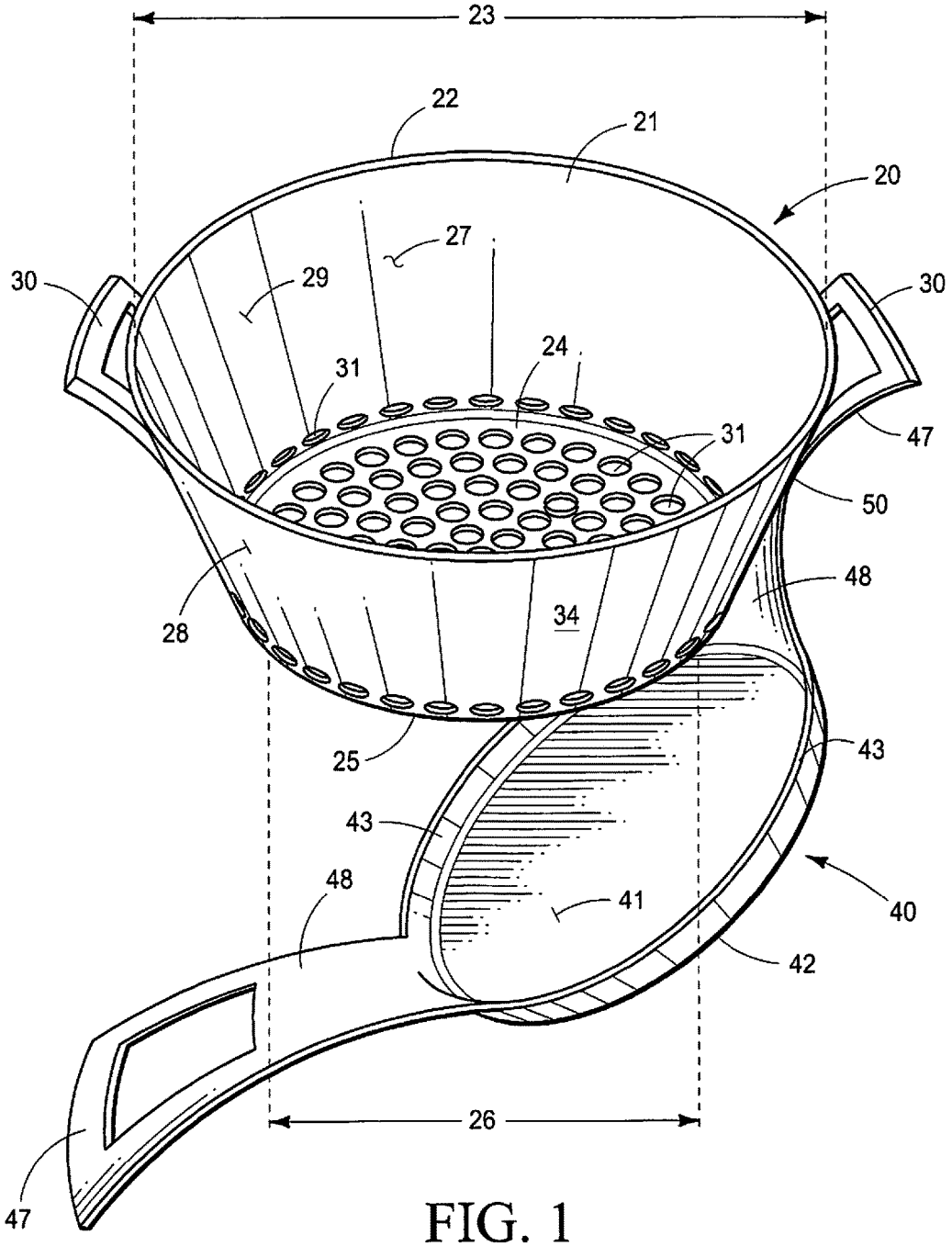
FIG. 1 is an isometric top and first side view of the collection and sifting device showing the bottom cap pivoted partially away from the bottom portion to unobstruct the plurality of holes defined in the bottom portion and the sidewall.
Figure 2:
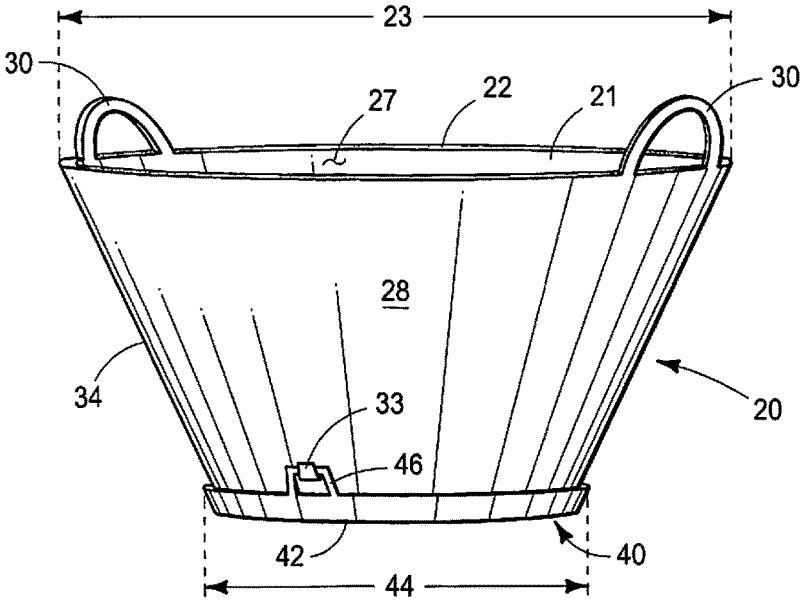
FIG. 2 is an orthographic side view of a second embodiment of the sifting device, showing the bottom cap in a closed position and two diametrically opposed handles at the open top portion.
Figure 8:
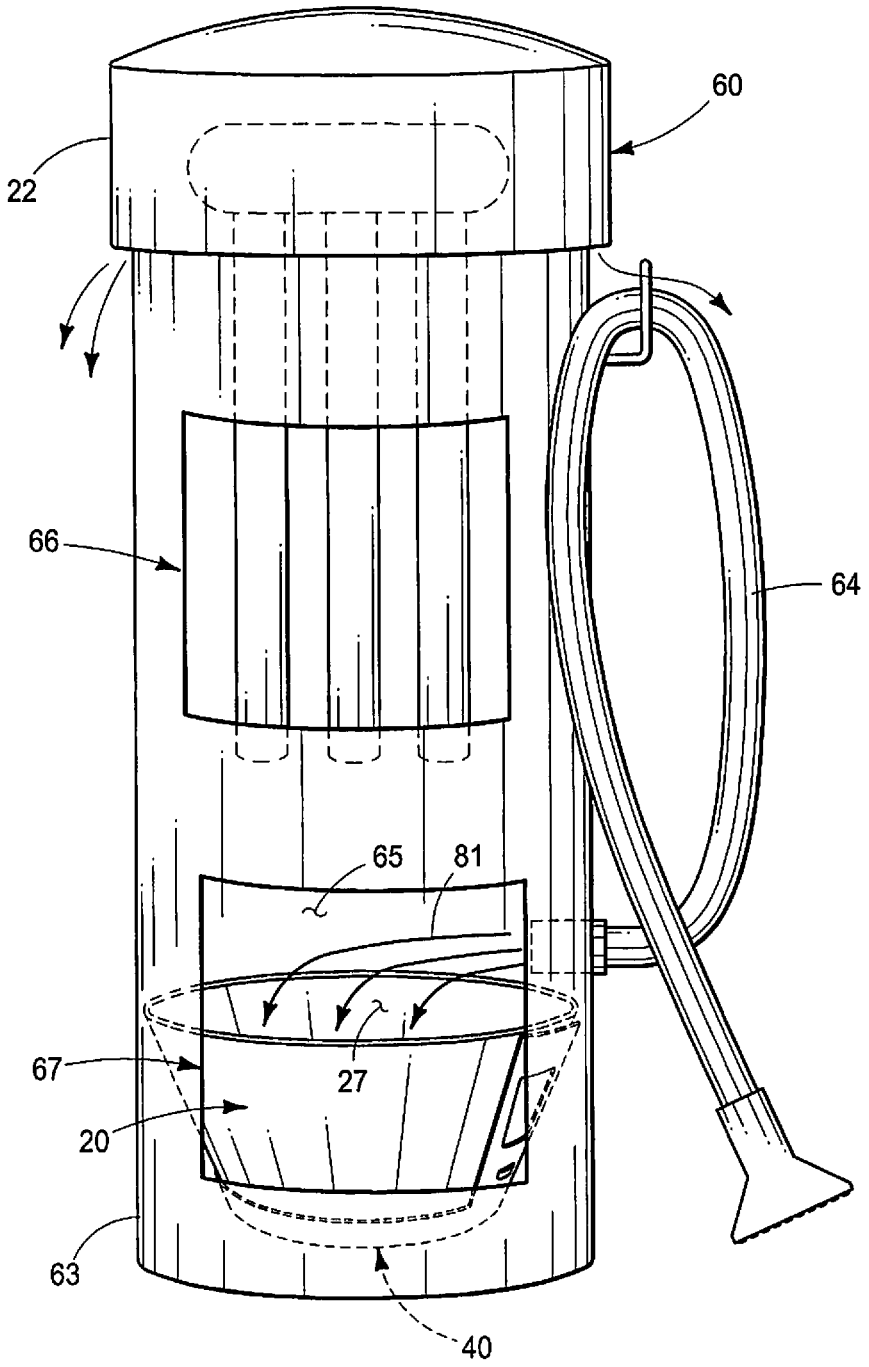
FIG. 8 is an orthographic, partial cutaway side view of a typical carwash power vacuum assembly showing the instant invention therein through the access door with arrows representing the flow of vacuumed debris into the body and representing filtered air being exhausted from the housing.

The body 20 has a general configuration of a truncated funnel having an open top portion 21 defining a top circumferential edge 22 and further defining a top diameter 23. A closed bottom 24 is carried by the body 20 spaced apart from the open top 21. The closed bottom 24 defines a bottom circumferential edge 25 and further defines a bottom diameter 26. A sidewall 34 extends between the closed bottom 24 and the open top 21. An interior volume 27 is defined between the closed bottom 24 and the top circumferential edge 22 and an inner surface 29 of the sidewall 34. An exterior surface 28 extends along the sidewall 34 opposite the interior volume 27. At least one handle 30 and preferably two handles 30 are carried by the body 20 proximate the top circumferential edge 22 to facilitate grasping by a user and agitation by a user. (FIGS. 2, 4). In one embodiment (FIGS. 1, 4, 5) the handles 30 are interconnected with the exterior sidewall 28 and do not extend above the top edge 22. In a second embodiment (FIGS. 2, 3) the handles 30 are interconnected with the body 20 at the top edge 22 and extend upwardly therefrom. The handle 30 placement is generally controlled by available space within the volume 65 of the vacuum 60. (FIG. 8).

Figure 7A:
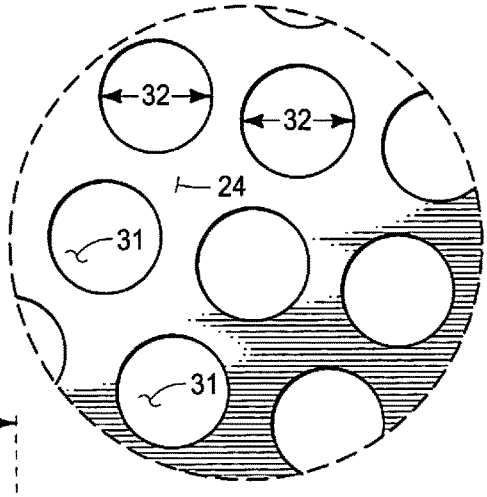
FIG. 7A is an enlarged view of a portion of the body bottom showing the diameter of the plurality of spacedly arrayed holes.

A plurality of spacedly arrayed through holes 31 are defined in the closed bottom 24 and in the sidewall 34 proximate the closed bottom 24. The holes 31 communicate between the interior volume 27 and the exterior of the body 20. As shown in FIG. 7A, each hole 31 has a diameter 32 and the diameter 32 is less than approximately 18 mm and is less than the diameter of a U.S. dime.

Figure 3:
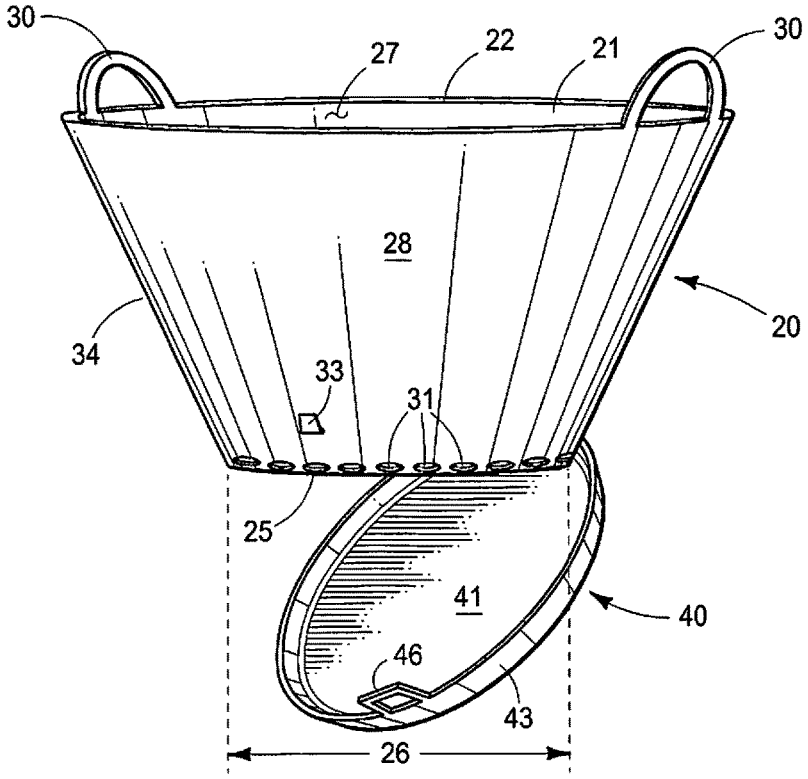
FIG. 3 is an orthographic side view, similar to that of FIG. 2 showing the bottom cap pivoted to an open position.
Figure 4:
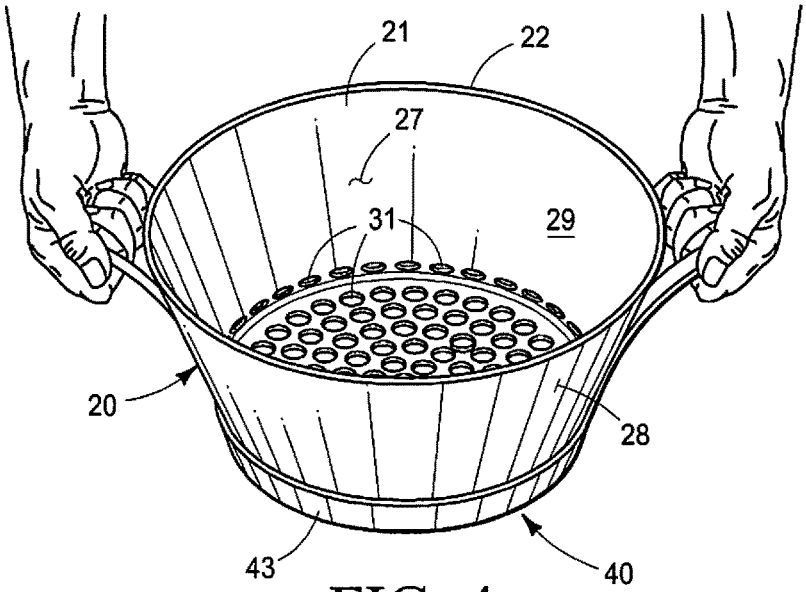
FIG. 4 is an isometric top and second side view of the sifting device of FIG. 1 showing how the device would be grasped by a user with the bottom cap in a closed position.

As shown in FIGS. 2, 3 in a second contemplated embodiment, a locking protrusion 32 may be carried on the exterior circumferential surface 28 of the sidewall 34 to provide a locking attachment for the bottom cap 40 so as to secure the bottom cap 40 in a closed position relative to the body 20.

In the preferred embodiment, the handles 30 carried by the body 20 are at generally diametrically opposed positions on the body 20 and in the preferred embodiment the body 20 is formed of rubber, fiber reinforced rubber or a flexible thermoplastic. Materials other than those specifically identified herein may likewise be used to form the body 20 and the bottom cap 40 so long as the materials are durable, flexible, resilient and have retentive memory and are resistant to wear and tear during use. Flexibility is necessary because access doors 67 defined in vacuum housings 65 are typically dimensionally smaller than the body 20.

The bottom cap 40 is somewhat "cake-pan" like in configuration and is generally circular. The bottom cap 40 has an upper surface 41, an opposing bottom surface 42 and a circumferentially extending sidewall 43 that extends somewhat angularly upwardly and outwardly from the upper surface 41. The bottom cap 41 further has an inside diameter 44 that is slightly larger than the diameter 26 of the bottom of the body 20 so that the circumferentially extending wall 43 of the bottom cap 40 covers and obstructs the holes 31 defined in the sidewall 34 of the body 20 when the bottom cap 40 is in a closed orientation (FIGS. 2, 4). The bottom cap 40 is preferably formed of the same material as the body 20, but may also be formed of a different material.

Figure 5:
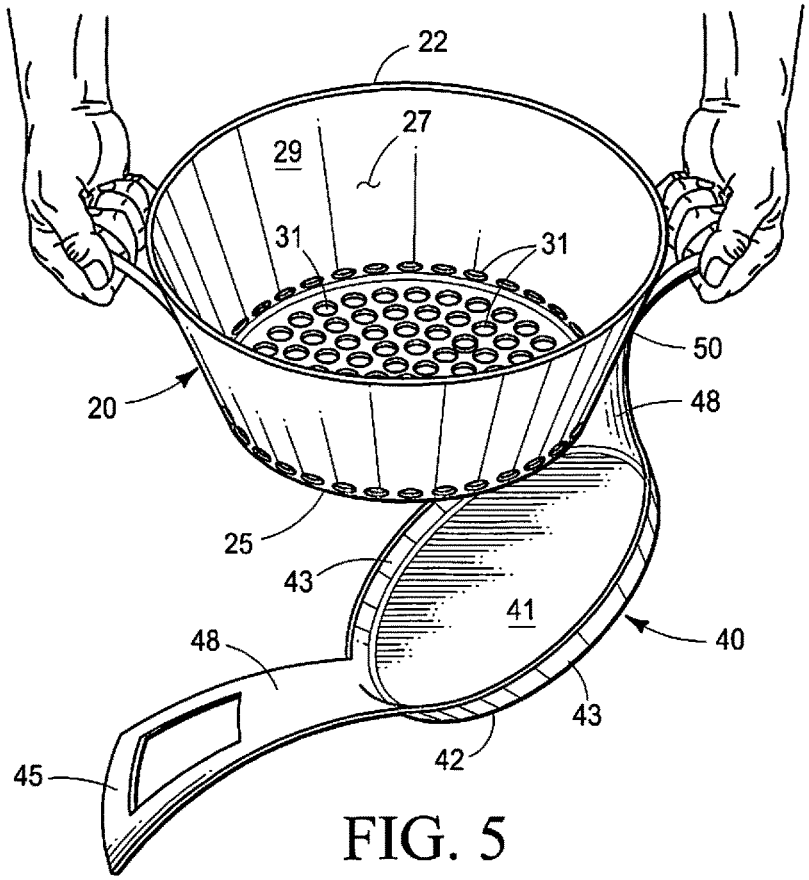
FIG. 5 is an isometric top and first side view similar to that of FIG. 1 showing the bottom cap in an open orientation.
Figure 6:
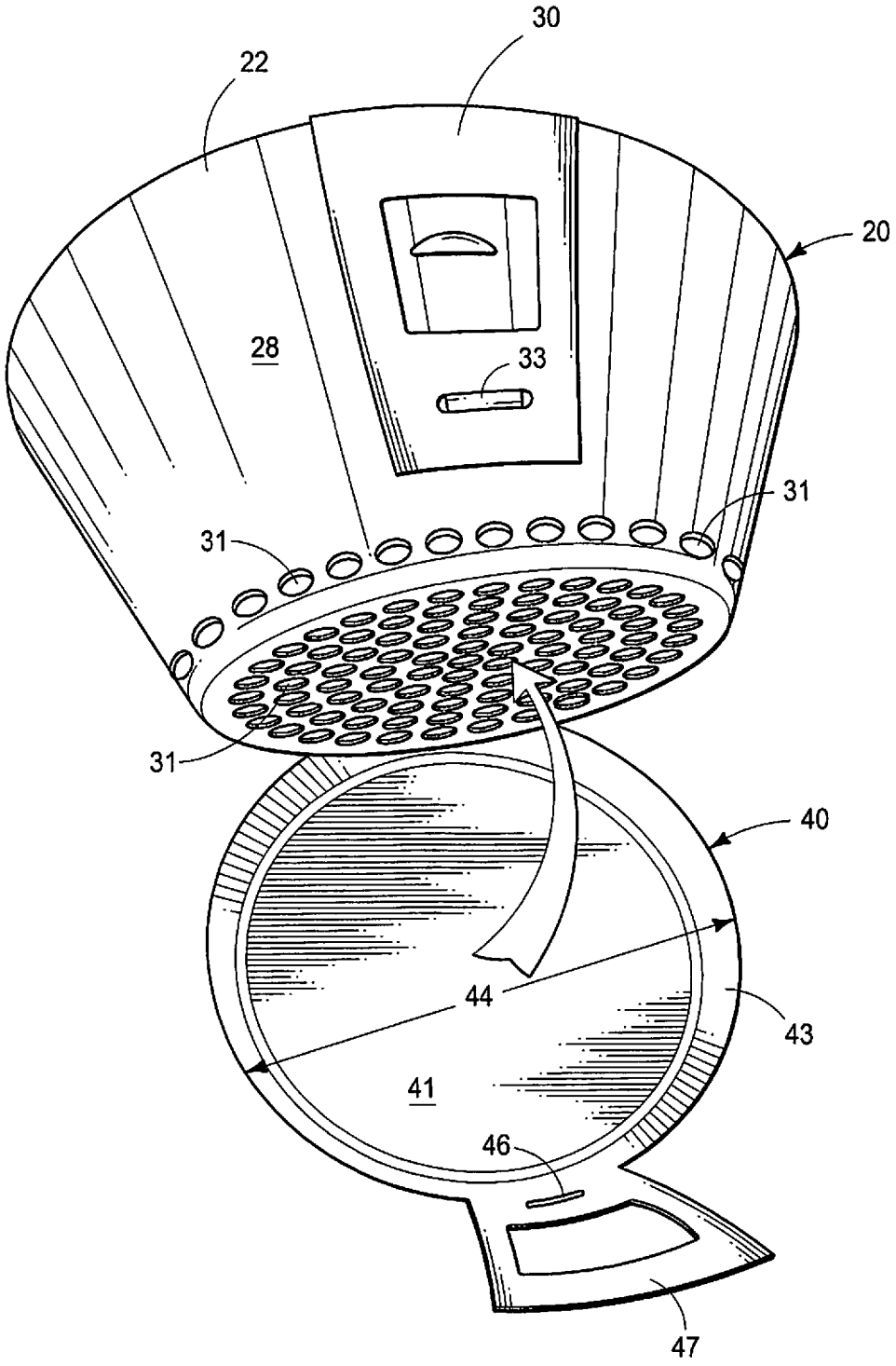
FIG. 6 is an isometric bottom and side view of the sifting device of FIG. 1, rotated 90 degrees counter-clockwise, showing how the bottom cap may be pivoted to an open position relative to the bottom of the body.
Figure 7:
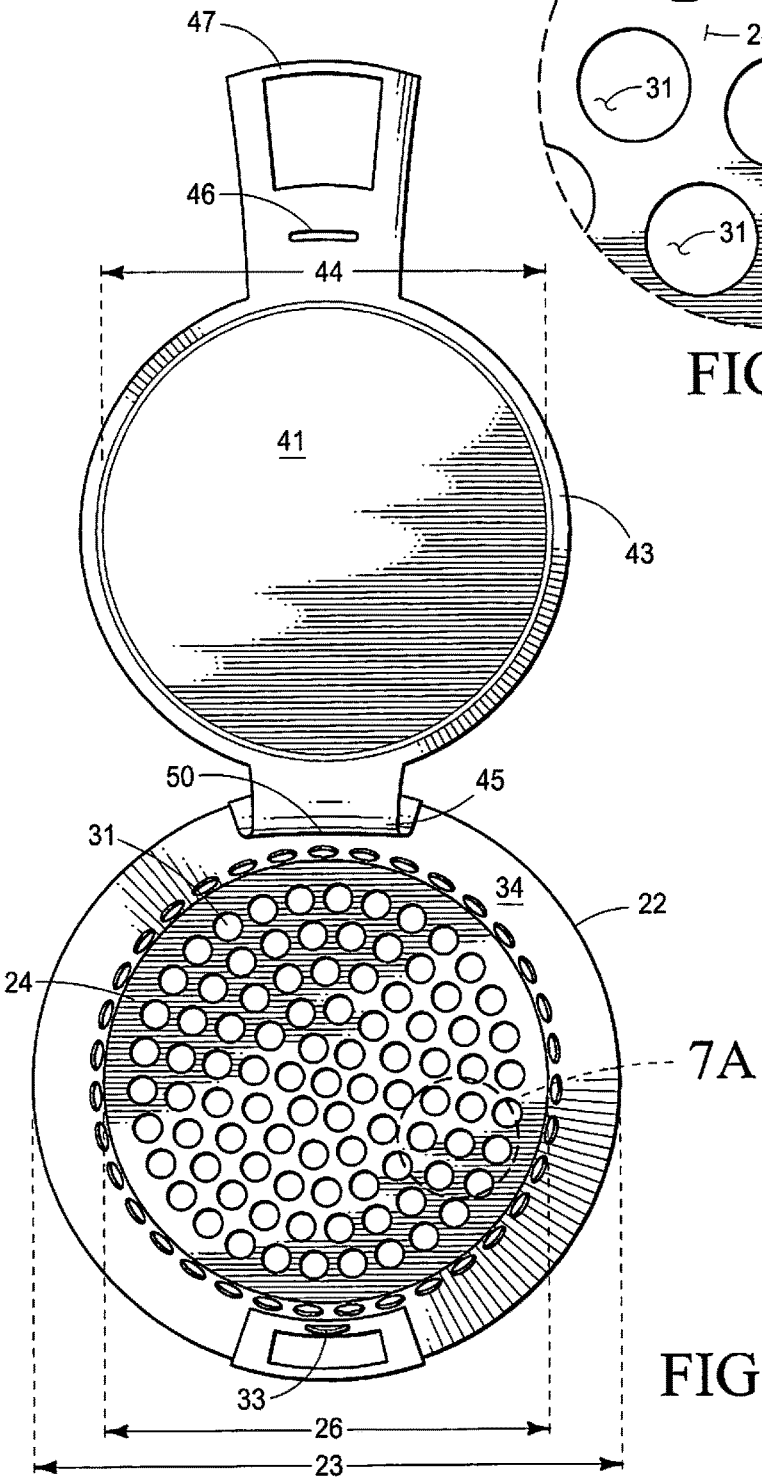
FIG. 7 is an orthographic bottom view of the instant invention showing the bottom cap pivoted completely away from the body.

In one embodiment, the bottom cap 40 is hingedly attached to the body 20 by means of a hinge 45 (FIG. 7) so that the bottom cap 40 may pivot outwardly from the body 20 to unobstruct the holes 31 (FIG. 9) during sifting. In another contemplated embodiment, the bottom cap 40 has one handle 47 that is diametrically opposite an interconnection 50 of the bottom cap 40 to the body 20. The one handle 47 cooperates with a handle 30 carried by the body 20 so that when a user grasps the two handles 47, 30 simultaneously, the body 20 and bottom cap 40 can be easily manipulated in unison. (FIG. 4). Handle 47 extends angularly and upwardly from the circumferentially extending wall 43 by means of a handle strap 48. (FIG. 5).

As noted previously in a second embodiment, a latch 46 may be carried by the bottom cap 40 at a position generally diametrically opposite the hinge 45. The latch 46 is releasably engagable with the locking protrusion 33 carried on the exterior circumferential surface 28 of the sidewall 34 of the body. (FIGS. 2, 3).

Operation

Having described the structure of my collecting and sifting device for vacuumed debris, its operation may be understood.

The body 20 is oriented so that the bottom cap 40 engages therewith by pivoting about the connection 50 so that the upper surface 41 of the bottom cap 40 is immediately adjacent the exterior bottom 24 of the body 20, and the circumferentially extending wall 43 carried by the bottom cap 40 covers or otherwise obstructs the holes 31 defined in the closed bottom 24 and in the sidewall 34 proximate the closed bottom 24.

In the embodiment where the bottom cap 40 carries handle 47 diametrically opposite the interconnection 50, the handle 47 may be cooperatively engaged with a handle 30 carried by the body 20 so that a user may simultaneously grasp the handles 47, 30 to keep the bottom cap 40 engaged to the body 20.

In the embodiment where the bottom cap 40 carries a latch 46 (FIGS. 2, 3), the latch 46 is engaged with the locking protrusion 33 carried on the exterior surface 28 of the sidewall 34 so that the bottom cap 40 is positionally secured in a closed orientation, as seen in FIG. 2.

The body 20 and the engaged bottom cap 40 are placed within interior of the vacuum housing 65 (FIG. 8) through an access door 67 at a location therein so that debris 81 vacuumed up by the vacuum 60 by means of the vacuum hose 64 are collected and deposited into the interior volume 27 defined by the body 20.

In the preferred embodiment, both the body 20 and the bottom cap 40 are formed of a flexibly resilient material such as rubber or flexible thermal plastic having retentive memory and that is durable and easy to clean. The flexibility of the material forming the body 20 and bottom cap 40 is essentially when an access door 67 is smaller than the body 20. Further, in the preferred embodiment, the diameter 23 of the top portion 21 is substantially similar to an interior diameter (not shown) of the vacuum housing 65 so that the great majority of vacuumed-up debris and the like are collected within the interior volume 27 and only minimal amounts of vacuumed-up debris fall between the upper circumferential edge 22 of the body 20 and the interior surface (not shown) of the vacuum housing 65.

The vacuum 60 is operated as is customary wherein customers vacuum up debris, typically from the interiors of their motor vehicles, and the vacuumed up debris 81 are collected in the interior volume 27 of the body 20 within the vacuum housing 65. After some period of time, depending on the amount of use, the operator removes the body 20 and the engaged bottom cap 40 from the interior of the vacuum housing 65 by simultaneously removing the body 20 and bottom cap 40 through the access door 67. Because the access door 67 may have dimensions smaller than the body 20, the flexible resiliency of the body 20 allows the body 20 to be manipulated into and out of the vacuum 60.

Figure 9:
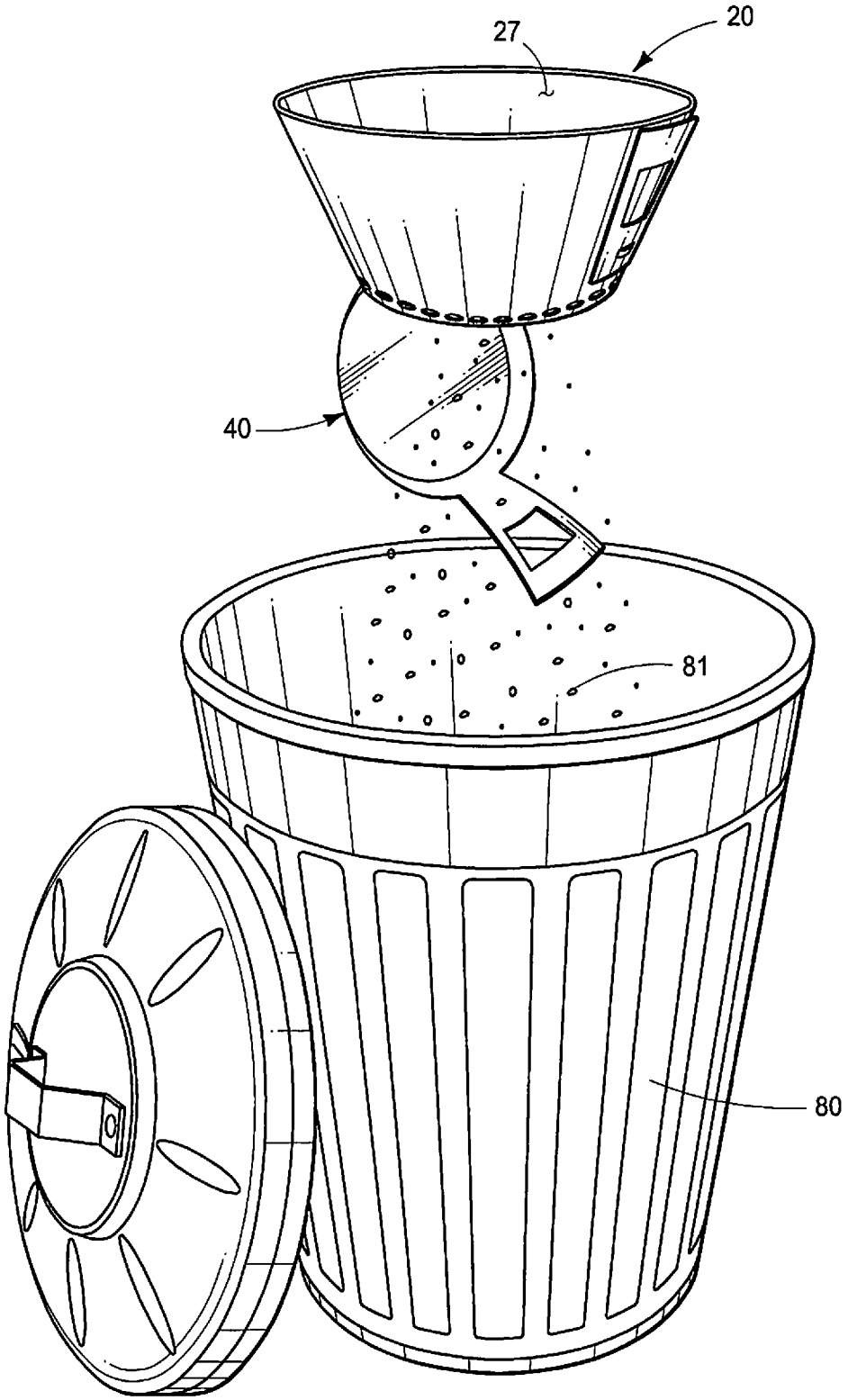
FIG. 9 is an artistic representation of the instant invention positioned above a trash receptacle with the bottom cap pivoted to an open position and collected vacuumed debris falling through the plurality of holes defined in the body and falling into the trash receptacle.

As shown in FIG. 9, the user grasps the body 20 and the closed bottom cap 40 containing the vacuumed up debris 81, and orients the body 20 and closed bottom cap 40 vertically above a trash receptacle 80, such as a garbage can having an open top. Once oriented above the opening of the trash receptacle 80, the bottom cap 40 is disengaged from the body 20 allowing the bottom cap 40 to pivot downwardly and away from the body 20 which unobstructs the holes 31 defined in the closed bottom 24 and sidewall 34 of the body 20. The user would then agitate the vacuumed-up contents of the body 20 such as by shaking. Particles, dust, dirt and the like having diameters smaller than the diameter 32 of the holes 31 pass through the holes 31 and into the trash receptacle 80. Larger items, including coins and change and waste having diameters greater than the diameter 32 of the holes 31 are retained within the interior volume 27 of the body 20. Valuables, including coins and dollar bills that were vacuumed up, remain within the interior volume 27 so that they may be collected by the user. Larger debris that have no value, such as pieces of paper and plastic and the like, are easily separated from the valuables retained within the interior volume 27.

After the collected debris and valuables have been sifted, separated and collected or disposed of, the bottom cap 40 is reengaged with the body 20 and the combined body 20 and bottom cap 40 are replaced in the vacuum interior 65 through the access door 67 for continued operation and collection of debris.

I claim:

1. A collection and sifting device comprising:

a resiliently deformable truncated funnel shaped body formed of rubber having an open top portion defining an upper diameter and a closed bottom portion defining a bottom diameter that is smaller than the upper diameter and having a side wall extending between the top portion and the bottom portion, the body defining an interior volume between the open top portion and the diametrically smaller closed bottom portion and an interior surface of the side wall, the body further defining a plurality of spacedly arrayed through holes in the closed bottom portion, each of the spacedly arrayed through holes having a diameter that is smaller than a diameter of a US dime;

a bottom cap hingedly securable to the body with a hinge to optionally obstruct the plurality of spacedly arrayed through holes defined in the closed bottom when the bottom cap is oriented in a closed position; and wherein the truncated funnel shaped body is operatively carried within a powered vacuum and is configured to catch and collect vacuumed debris within a housing of the powered vacuum to allow sifting of the collected vacuumed debris.

2. The collection and sifting device of claim 1 further comprising:

a plurality of through holes defined in the sidewall of the truncated funnel shaped body proximate the closed bottom;

a circumferentially extending side wall carried by the bottom cap, the circumferentially extending sidewall extending angularly upwardly from an upper surface of the bottom cap to communicate with the exterior surface of the truncated funnel shaped body sidewall to optionally obstruct the plurality of through holes defined in the sidewall of the body;

a handle carried by the body; and a latch having a first portion carried on an exterior surface of the truncated funnel shaped body sidewall and a second portion carried by the bottom cap, the first and second portions of the latch releasably engageable to optionally secure the bottom cap in a closed position relative to the body so that the plurality of spacedly arrayed through holes defined in the closed bottom portion are obstructed.

3. A collection and sifting device for catching vacuumed debris and separating the vacuumed debris, the sifting device comprising:

a resiliently deformable rubber body having an open top portion defining an upper diameter and a closed bottom portion defining a bottom diameter that is smaller than the upper diameter with a side wall extending between the top portion and the bottom portion, the body defining an interior volume between the open top portion and the closed bottom portion and an interior surface of the side wall, the body further defining a plurality of spacedly arrayed holes defined in the closed bottom portion and defined in the side wall proximate the closed bottom portion, each of the spacedly arrayed holes having a diameter that is less than a diameter of a US dime, and each of the spacedly arrayed holes extending from the internal surface of the body and within the interior volume to an exterior surface of the body opposite the interior volume;

a handle carried by the body to facilitate agitation of the debris collected within the interior volume;

a bottom cap having an upper surface and a circumferentially extending sidewall extending angularly from the upper surface, the bottom cap pivotally attached to the body to optionally obstruct the plurality of spacedly arrayed holes defined in the closed bottom and in the body side wall when the bottom cap is oriented in a closed position; and a latch communicating between the body and the bottom cap to optionally secure the bottom cap in a closed position relative to the body and obstruct the spacedly arrayed holes defined in the body.

* * * * *